US006308343B1

(12) United States Patent
Arai

(10) Patent No.: US 6,308,343 B1
(45) **Date of Patent: *Oct. 30, 2001**

(54) FULL-FACE TYPE HELMET

(76) Inventor: Michio Arai, c/o Arai Helmet, Ltd., 12 Azuma-cho, 2-chome, Ohmiya-shi, Saitama-ken (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/264,029

(22) Filed: Mar. 8, 1999

(30) Foreign Application Priority Data

Oct. 30, 1998 (JP) ..... 10-311274

(51) Int. Cl.[7] ..... A42B 3/00
(52) U.S. Cl. ..... 2/414; 2/422
(58) Field of Search ..... 2/410, 411, 414, 2/424, 425, 422

(56) References Cited

U.S. PATENT DOCUMENTS 4,796,309 * 1/1989 Nava ..... 2/414
5,095,550 * 3/1992 Perlinger ..... 2/422

FOREIGN PATENT DOCUMENTS 63-211313 2/1988 (JP) .
16482 7/1962 (TW) .
34375 12/1980 (TW) .

* cited by examiner

*Primary Examiner*—Michael A. Neas
(74) *Attorney, Agent, or Firm*—Dykema Gossett PLLC

(57) ABSTRACT

A full-face type helmet which fits comfortably, protects against cold wind and prevents soiling of the inner liner members includes a cover member covering the lower surfaces of the inner liner members to reduce noise caused by wind. The cover member causes wind to flow smoothly without any resistance in a rearward direction, and includes insertion plates at its opposite ends for connection to the shell of the helmet or liner members therein.

1 Claim, 6 Drawing Sheets

FULL-FACE TYPE HELMET

BACKGROUND OF THE INVENTION

1. Field of the Invention

This invention relates to a full-face type helmet which protects a user's head or face when riding on various kinds of motorized vehicles such as motorcycles or automobiles.

2. Description of the Prior Art

As shown in FIG. 10 inner liner assemblies arranged within the shell 102 of the prior art full-face type helmet F to assure safety and riding comfort, a head part inner liner member 104 for protecting the head of the user, cheek inner liner members 103L, 103R for protecting a user's cheeks, and a chin inner liner member for protecting a user's chin, and may include a cover member 100 removably installed in the helmet in addition to each of these inner liner members.

This cover member 100 (hereinafter called as a neck pad) is made of foamed urethane or like material which is soft and resilient, formed into a U-shape as seen in a top plan view, an insertion piece 101 arranged at its outer circumferential edge inserted among a shell 102, cheek inner liner members 103L, 103R and the head part inner liner member 104 so as to cover the cheek inner liner members 103L, 103R and the lowermost surface of the head part inner liner member 104. The cover member 100 provides a good fitting characteristic to the helmet (reduction in looseness), protection against running wind, and protection against soiling of each of the inner liner members.

However, although the prior art full-face type helmet F provided with this neck pad 100 realized various kinds of effects described above, the neck pad 100 merely overlapped on the lower end surfaces 106L, 106R of the cheek inner liner members 103L, 103R, and at the same time both extremity end portions 107L, 107R of the neck pad 100 were positioned in the midway part of each of the lower end surfaces 106L, 106R of the cheek inner liner members 103L, 103R and fixed there, so that as shown in FIG. 10, a certain step was formed by the neck pad 100 and the cheek inner liner members 103L, 103R and a certain gap was formed between these members, resulting in these steps and gaps becoming resistant to the running wind when the wind passed through both right and left sides of the neck part of the user and the resistance may generate wind noise.

SUMMARY OF THE INVENTION

The present invention has been invented in view of the aforesaid circumstances found in the prior art and it is an object of the present invention to provide a full-face type helmet wherein its comfortable feeling (reduction in looseness), protection against cold wind and protection against soiling of each of the inner liner members, while at the same time reducing noise caused by the wind passing the helmet is reduced.

The object of the invention is achieved by providing that the cover member covering the inner liner assemblies positioned at at least both right and left sides of a shell is fixed by supporting from near the lower end of the shell to the lower surface of the full-face type helmet having inner liner assemblies composed of each of inner liner members inside the full-face type shell, the cover member is spaced apart at its forward extremity end part from the lower end of the shell with soft raw material, and formed to be elongated over the lower end surfaces of the inner liner members at the cheeks of the inner liner assemblies up to the front end surfaces, its forward extremity end is engaged with cheek inner liner members or a chin inner liner member or the shell through engaging means and the lower surfaces below the ears of the user are formed as flat surfaces from the lower part at the front surface to the rear part of at least the cheek inner liner members.

The aforesaid cover member is arranged at the lowermost surface of the helmet so as to cover the inner liner assembly arranged inside the shell, for example, in the case that the inner liner assembly is constituted by the head part inner liner member, the cheek inner liner members and the chin inner liner member, the cover member having a format to cause the lowermost surface of the helmet to become flat surfaces is arranged at these lower ends and in addition in the case that the inner liner assembly is constituted by having the neck pad in addition to each of the aforesaid inner liner members, the cover member having a format in which the lowermost surface of the helmet is made as a flat surfaces is arranged in place of this neck pad and in addition, a separate cover member having a format in which the lowermost surface of the helmet is made as a flat surfaces is arranged at the lower end of the neck pad.

In addition, as a practical form of the cover member, for example, it is possible to apply a lateral integral type U-shaped form as seen in its plan view and a shape in which separate right and left segments are formed and both right and left segments are coincided with the flat shapes of both right and left sides of the neck part.

The aforesaid engaging means includes all the means in which the extremity end of the cover member can be engaged with the cheek inner liner members or the chin inner liner member of the shell, wherein it may be possible to apply, for example, each of the means such as a convex or concave engagement or the like such as an insertion engagement, a hooked engagement, a hook or a velvet type fastener or the like in which the extremity end of the cover member is engaged with each of the aforesaid engagement locations.

As the full-face type helmet of the present invention, any one of a system pad type in which the cheek inner liner members are removably arranged or a fixed type system in which the cheek inner liner members are not removably attached can be carried out.

In accordance with the technical means of the present invention, a running wind through-pass surfaces at both right and left sides of at least the neck part of the user in the lowermost surface of the helmet can be made as flat surfaces and at the same time it is possible to eliminate the gap or the step part in respect to the inner liner assembly. In addition, the present invention also has some effects of the full-face type helmet provided with the aforesaid prior art neck pad such as a more comfortable wearing characteristic of the helmet (restriction against looseness), protecting against cold running wind, and protection against soiling of each of the inner liner members.

DETAILED DESCRIPTION OF THE INVENTION

Figure 1:
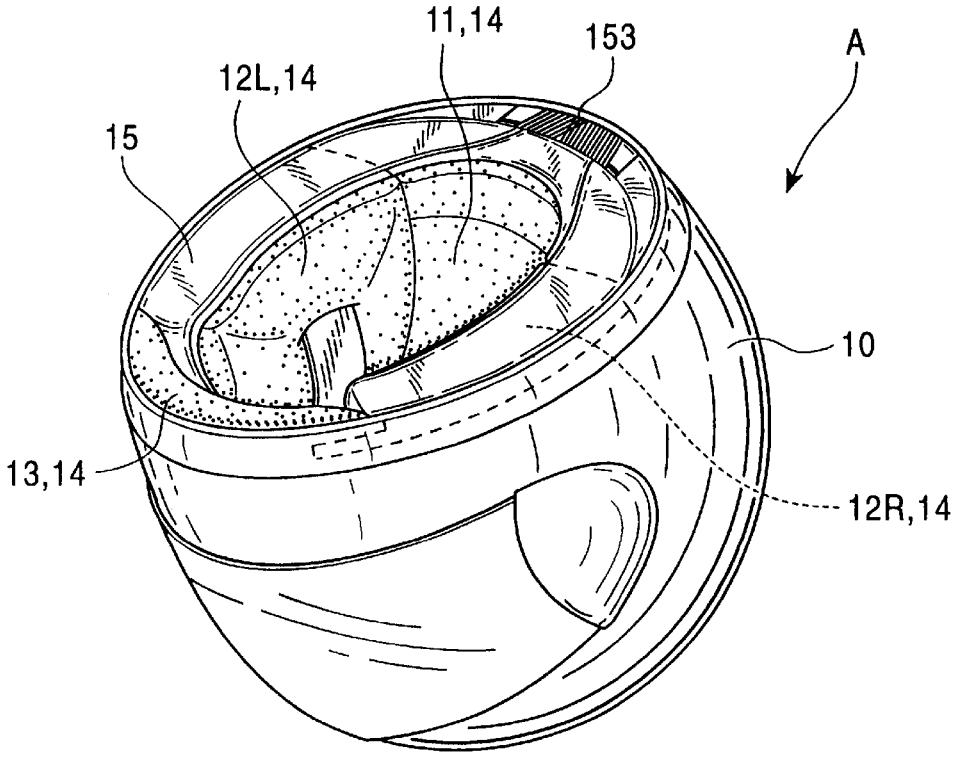
FIG. 1 is a perspective bottom view of a full-face type helmet according to a first preferred embodiment of the present invention.

FIG. 1 illustrates a full-face type helmet A of a system pad type to which the present invention is applied, wherein this full-face type helmet includes a shell 10 containing an inner liner assembly 14 made up of a shock absorbing liner (not shown) made of expanded polystyrene foam or raw material having a similar shock absorbing performance, a head part inner liner member 11 made of urethane material arranged inside the shock absorbing liner, right and left cheek inner liner members 12L, 12R removably arranged at both sides corresponding to the cheeks and chin of a user, and a chin inner liner member 13 arranged inside the chin guard section of the shell 10. The shell 10 is formed into a predetermined shape by fiber reinforced resin material. A cover member 15 is removably arranged in the shell 10 to cover the lowermost surface region of the liner assembly 14 except the chin part inner liner member 13.

Figure 2:
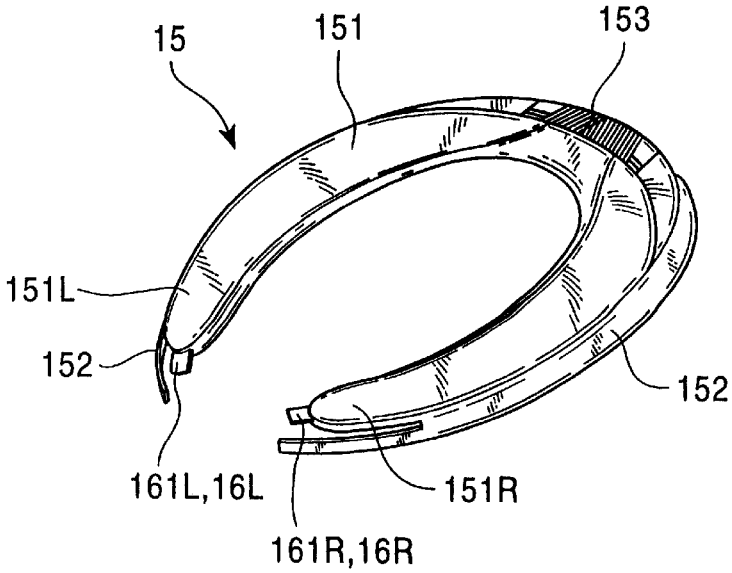
FIG. 2 is a perspective view of a cover member used in the helmet of FIG. 1.

As seen in FIG. 2, the cover member 15 includes a cover section 151 of foamed urethane or similar material having a softness and resiliency that will not damage a user, and formed into a U-shape as seen in its top plan view as shown in FIG. 2; an insertion piece 152 made of soft synthetic resin arranged at the outer circumferential edge of the cover section and inserted between the shell 10 and the inner liner assembly 14; a discharging port 153 arranged at a rear part of the cover section 151 so as to discharge hot air from within in the helmet; and insertion plates 161L, 161R arranged at both extremity ends 151L, 151R of the cover section 151 so as to constitute a part of the engaging means 16L, 16R to be described later.

Since the right and left cheek inner liner members 12L, 12R, engaging means 16L, 16R and both extremity ends 151L, 151R at the cover section 151 are formed in the same shapes at their right and left segments, only one cheek inner liner member 12L, engaging means 16L and their associated composing member, the extremity end 151L will be described in the following description and to the contrary, description of the other cheek inner liner member 12R, the engaging means 16R, their associated member and the extremity end 151R will be omitted.

Figure 3:
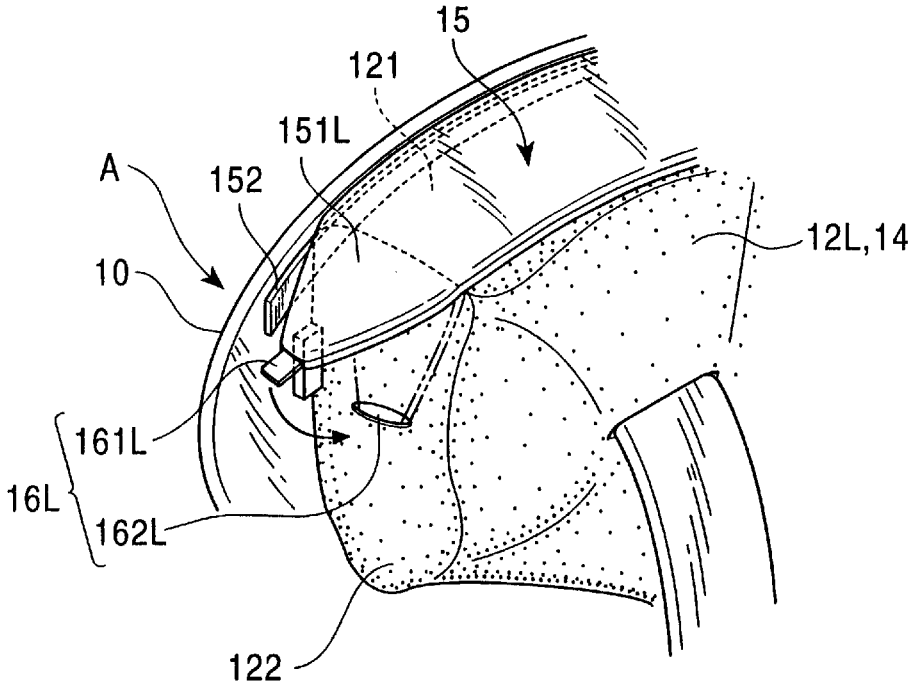
FIG. 3 is an enlarged perspective view illustrating how the cover member is inserted in the helmet.

The aforesaid cover section 151 is made to have such a length as that its extremity end 151L reaches up to a midway part of the front end surface 122 of the aforesaid cheek inner liner member 12L, i.e., after the aforesaid insertion piece 152 is inserted between the shell and the cheek inner liner member 12L as shown in FIG. 3, the cover section 151 is bent or folded at these corners ranging from the lower end surface 121 to the front end surface 122 of the cheek inner liner member 12L, thereby the extremity end 151L is transferred to the midway part of the front end surface 122 of the cheek inner liner member 12L and at the same time it is engaged and fixed through the aforesaid engaging means 16L.

The engaging means 16L is comprised of the aforesaid insertion plate 161L and an insertion port 162L arranged at the front end surface 122 of the cheek inner liner member 12L as shown in FIG. 3, and the insertion plate 161L is inserted into and engaged with the insertion port 162L in such a way that it may be pulled out of or inserted into it.

Figure 4:
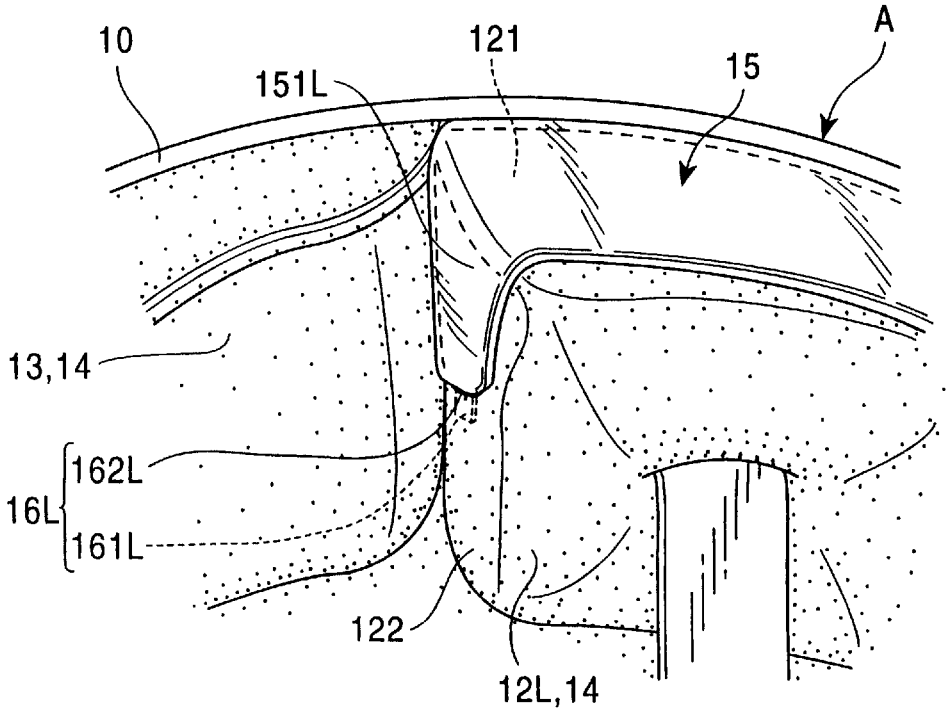
FIG. 4 is an enlarged perspective view depicting a cover member arranged in the helmet.

Such a cover member 15 as constructed above is fixed by a method wherein after the insertion piece 152 is inserted between the shell 10 and the inner liner assembly 14, the extremity end 151L of the cover section 151 is transferred up to the front end surface 122 as described above while utilizing a resiliency of the cheek inner liner member 12L, and the insertion plate 161L is inserted into and engaged with the insertion port 162L (see FIG. 4).

The full-face type helmet A of the present preferred embodiment is constructed as described above to cause the lowermost surface of the helmet ranging from the lower part of the front surface of the cheek inner liner member 12L to its rear portion to be formed as flat surfaces and the running wind is flowed smoothly in a rearward direction without any resistance to result in reduction in wind whistling sounds.

Next, the second preferred embodiment of the present invention will be described. However, this preferred embodiment is also a full-face type helmet of system pad type which is similar to that of the first preferred embodiment described above and so description and illustration of their overlapped portions will be eliminated.

Figure 5:
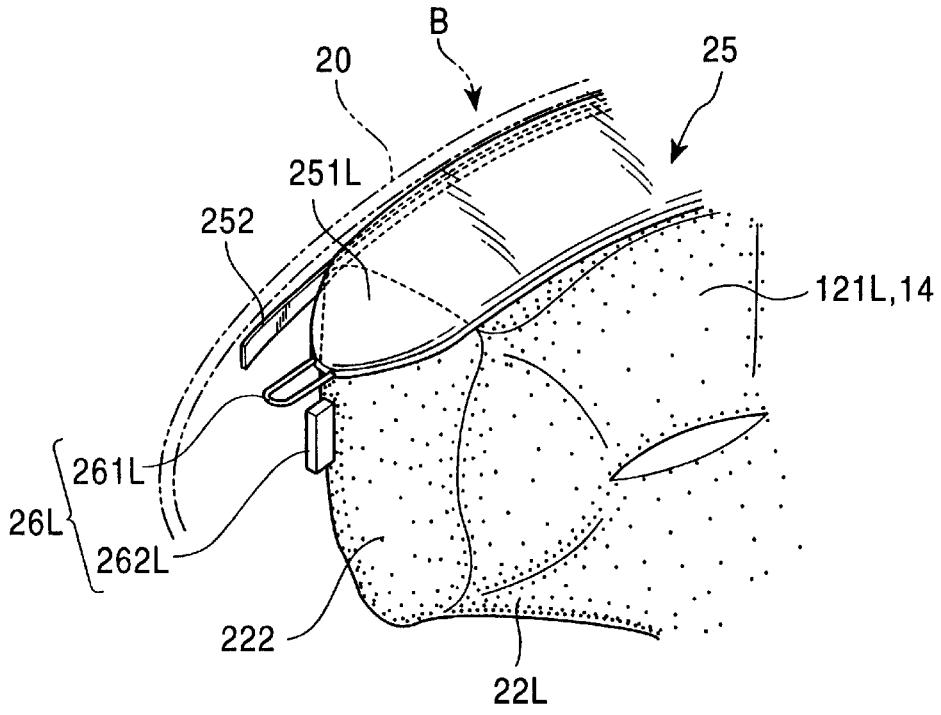
FIG. 5 is a perspective view of a portion of a full-face type helmet according to a second preferred embodiment of the present invention and depicting a midway state in which the cover member is arranged.
Figure 6:
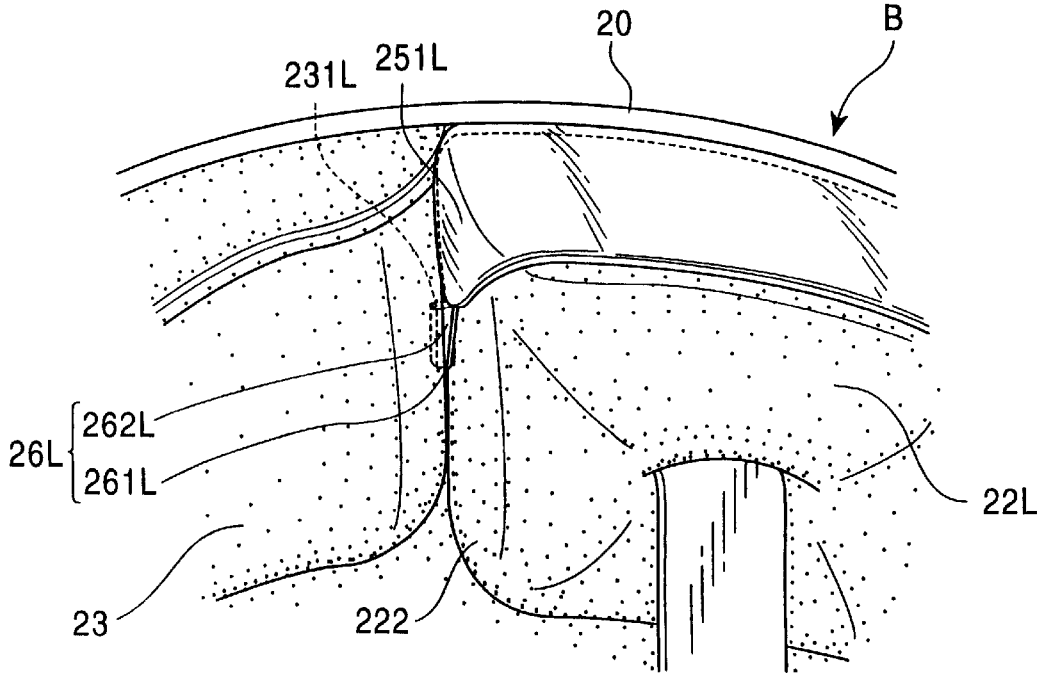
FIG. 6 is an enlarged perspective view showing a substantial part in a state in which the cover member is arranged.

As shown in FIGS. 5 and 6, a full-face type helmet B in this preferred embodiment is made such that the aforesaid engaging means 16L for the insertion and engagement is replaced with an engaging means 26L for hook and engagement.

The engaging means 26L is comprised of a hook ring 261L arranged at an extremity end 251L of a cover section 251 of a cover member 25 and of a fitting protrusion 262L installed at the cheek inner liner member 22L and arranged between the chin inner liner member 23 and the shell 20, wherein the hook ring 261L is hooked to the fitting protrusion 262L and engaged there.

One example of a method for fixing the cover member 25 in this preferred embodiment will be described, wherein at first the cover member 25 is applied to cover the cheek inner liner member 22L as described above before the cheek inner liner member 22L is fixed to the shell 20, the extremity end 251L is transferred to the front end surface 222, the hook ring 261L is hooked to the fitting protrusion 262L, thereafter the fitting protrusion 262L is fitted to the fitting protrusion 231L to cause the cheek inner liner member 22L to be fixed to the shell 20 (see FIG. 6).

The full-face type helmet B of this preferred embodiment is constructed as above, the lowermost surface of the helmet ranging from the lower part of the front surface of the cheek inner liner member 22L to its rearward position forms flat surfaces, and then it becomes possible to flow the running wind smoothly in a rearward direction without any resistance and to reduce wind whistling sound.

A third preferred embodiment of the present invention will now be described, this full-face type helmet C in this preferred embodiment being of a fixed type in which a cheek inner liner member 32L is not removably attached. In addition, description about the overlapped portions of the aforesaid preferred embodiment will be eliminated.

Since a practical configuration of the full-face type helmet C of this fixed type is well known in the art nowadays, its detailed description and illustration will be omitted. However, cheek inner liner members 32L and 32R (not shown) made of similar raw material as that described above are adhered to and fixed to both locations corresponding to the right and left cheek segments of a right and left integral type base member 38 having a substantial U-shape as seen in its top plan view made of raw material such as expanded polystyrene foam with a shock absorbing performance and integrally formed to be extended along a shape reaching to the location corresponding to an opposite side cheek segment ranging from a location corresponding to one cheek segment of either right or left side of the shell 30 through the chin guard location; wherein the right and left integral type base members may also act as the chin inner liner member 33.

Figure 7:
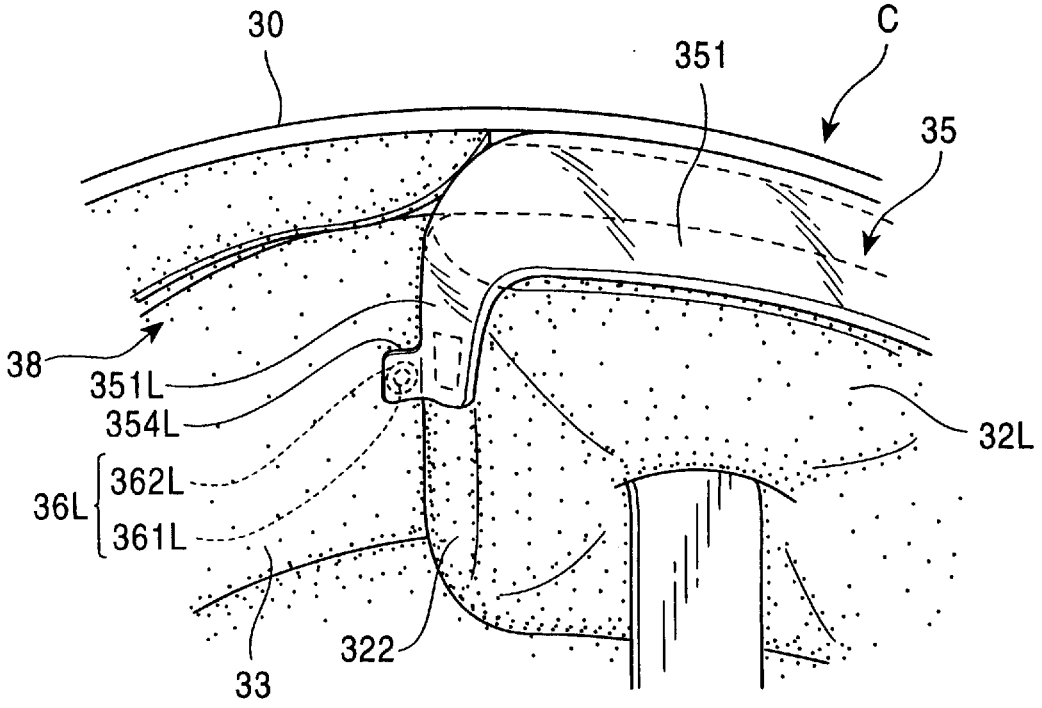
FIG. 7 is a perspective view of a portion of a full-face type helmet according to a third preferred embodiment of the present invention and illustrating a state in which the cover member has been arranged.

As shown in FIG. 7, an engaging means 36L of this preferred embodiment is a hook fixed over a protrusion surface 354L arranged at an extremity end 351L of the cover part 351 at the cover member 35 and over a chin inner liner member 33. In the following description, the engaging means 36L is described as a hook and the hook is denoted by reference numeral 36L.

The hook 36L is engaged through a concave or convex fitting, wherein the protrusion surface part 354L is provided with a protrusion 361L and the chin inner liner member 33 is provided with a concave part 362L.

A method for fixing the cover member 35 in this preferred embodiment is approximately similar to that of the first preferred embodiment, i.e., this method performs a fixing carried out such that after the insertion piece (not shown) is inserted, the extremity end 351L of the cover section 351 is transferred up to a front end surface 322 of the cheek inner liner member 32L and at the same time a protrusion part 361L is fitted to the concave part 362L.

The full-face type helmet C in this preferred embodiment is constructed as described above, thereby the lowermost surface of the helmet ranging from the lower part of the front surface of the cheek inner liner member 32L to the rear part becomes a flat surfaces and the running wind is flowed smoothly in a rearward direction without any resistance to enable wind whistling sound to be reduced.

Next, a fourth preferred embodiment of the present invention will be described, this preferred embodiment being a full-face type helmet of fixed type and which is similar to that of the third preferred embodiment described above. Description and illustration of their overlapped portions will be omitted.

Figure 8:
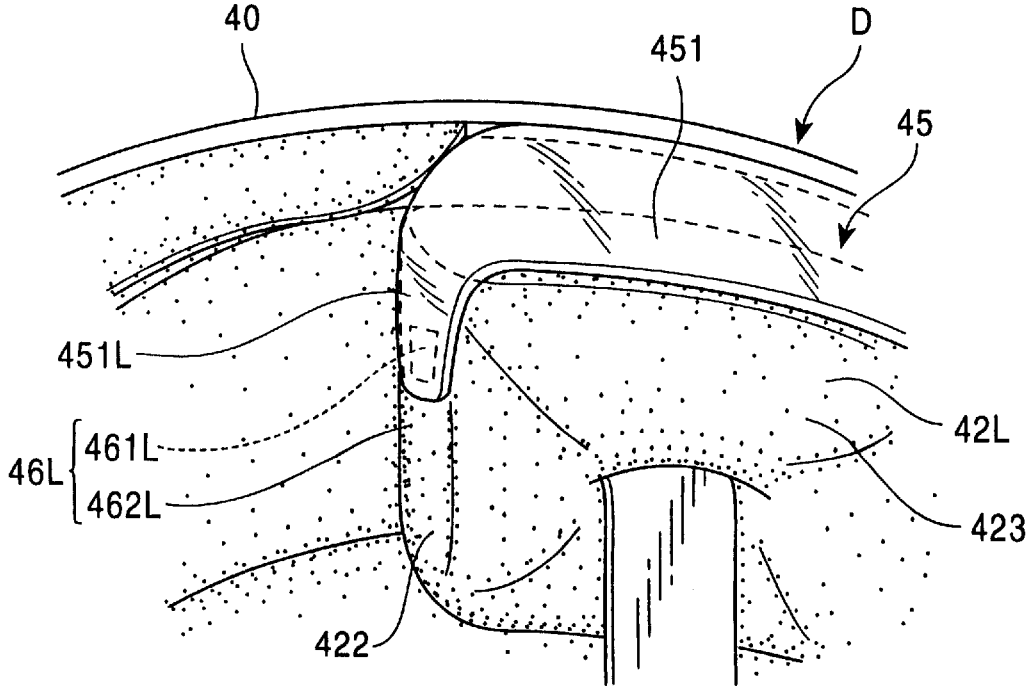
FIG. 8 is a perspective view of a portion of a full-face type helmet according to a fourth preferred embodiment of the present invention and illustrating a state in which the cover member has been arranged.
Figure 9:
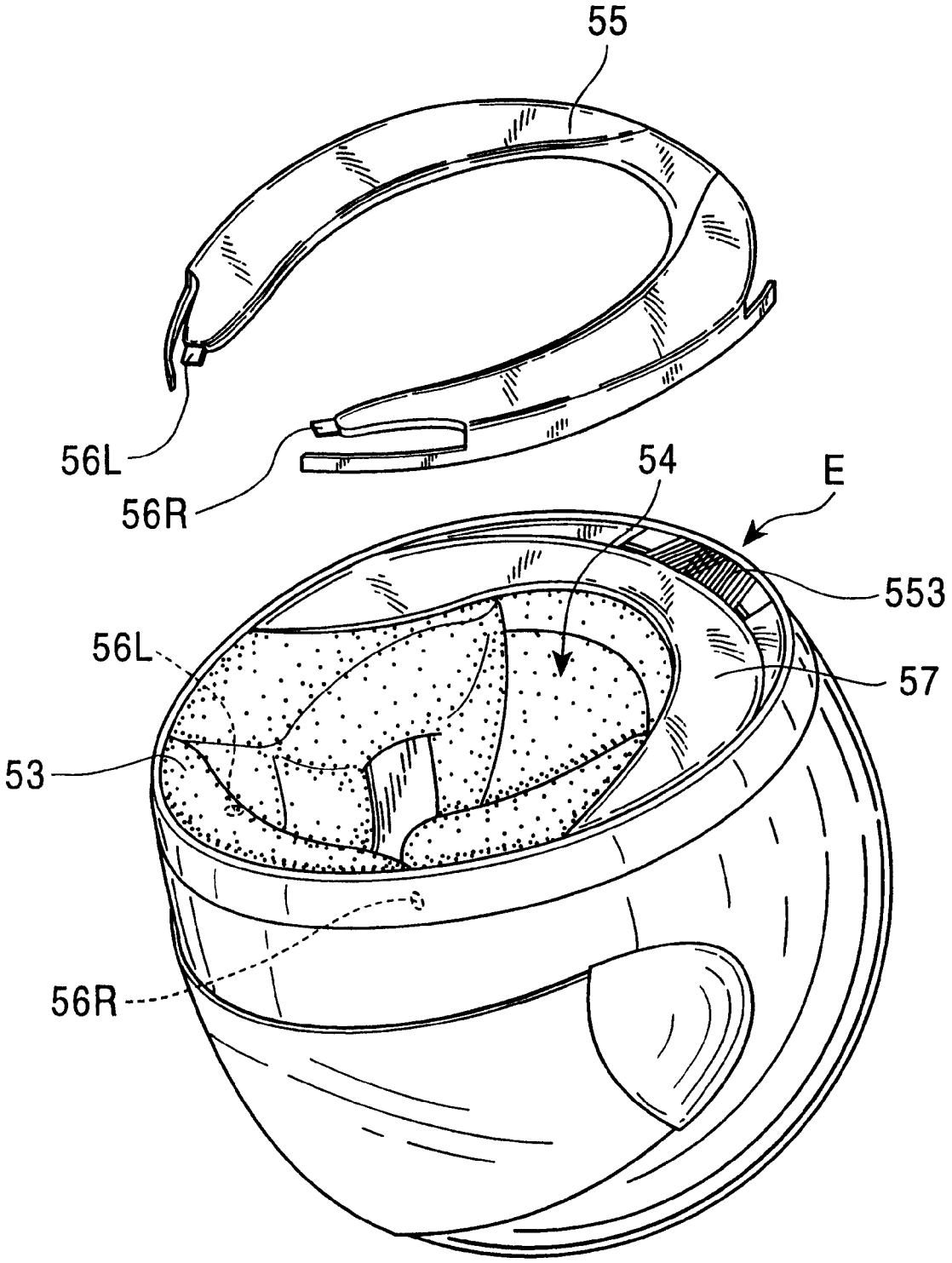
FIG. 9 is a perspective view of a portion of a full-face type helmet according to a fifth preferred embodiment of the present invention and illustrating a state in which the cover member is removed.
Figure 10:
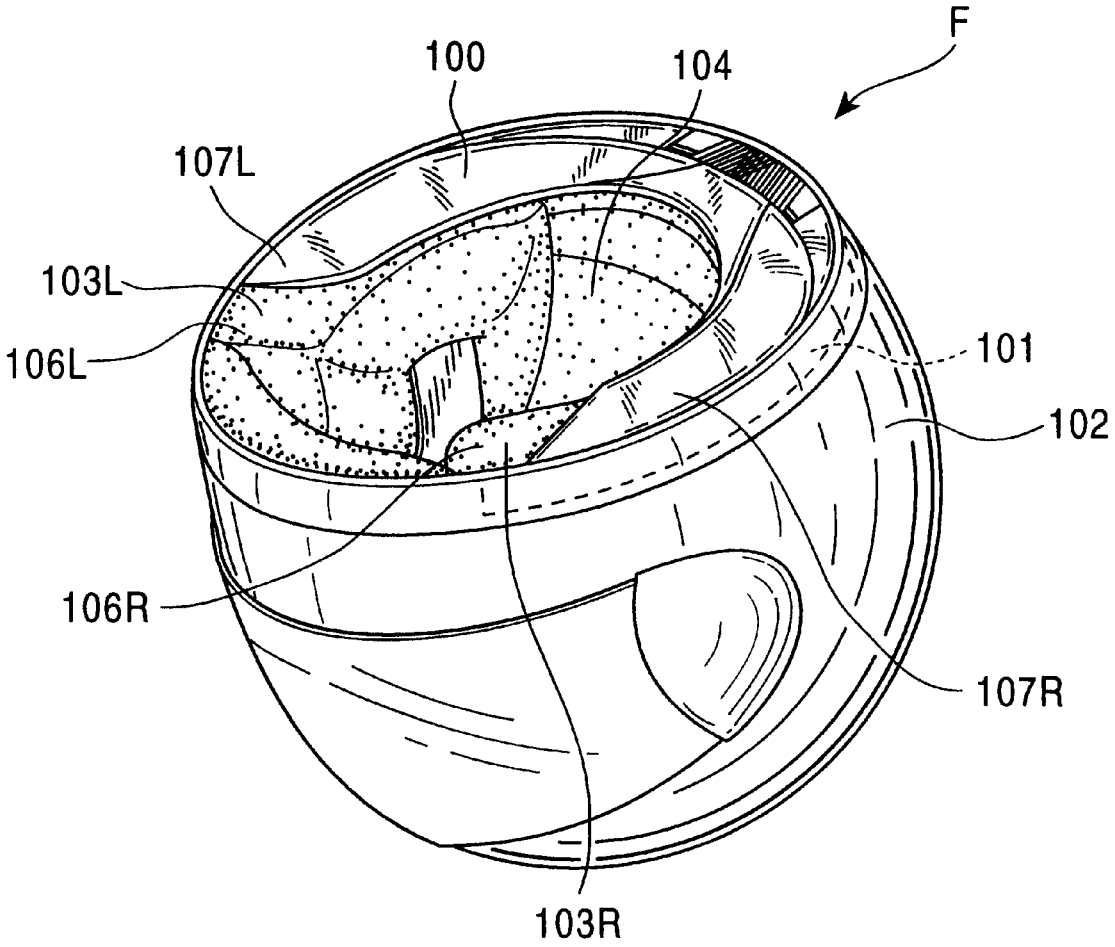
FIG. 10 PRIOR ART
FIG. 10 is a perspective view of a the prior art full-face type helmet.

As shown in FIG. 8, a full-face type helmet D in this preferred embodiment is constructed such that an engaging means 46L of a velvet type (hook and loop type) fastener is applied in place of the aforesaid engaging means 36L of the hook, and this is constituted by a male surface part 461L arranged at an extremity end 451L of a cover section 451 at the cover member 45 and a female surface part 462 under utilization of feather of an external liner member 423 at the cheek inner liner member 42L. In the following description, the engaging means 46L will be described as a velvet type fastener and the velvet type fastener is denoted by reference numeral 46L.

A method for fixing the corer member 45 in this preferred embodiment is approximately similar to that of the aforesaid third preferred embodiment, i.e., this fixing method is carried out such that after the insertion piece (not shown) is inserted, the extremity end part 451L of the cover part 451 is transferred up to the front end surface 422 of the cheek inner liner member 42L and at the same time a male surface part 461L of the velvet type fastener 46L is fixed to the female surface part 462L.

In this preferred embodiment, although the female surface part 462L of the aforesaid velvet type fastener 46L is provided with feather of the external liner member 423, it may also be applicable that the female surface part of the velvet type fastener proper may be arranged at the cheek inner liner member 42L and this female surface part may be arranged at the chin inner liner member (not shown).

The full-face type helmet D in this preferred embodiment is constructed as described above, thereby the lowermost surface of the helmet ranging from the lower part of the front surface in the cheek inner liner member 42L to its rear part forms a flat surfaces and it becomes possible to cause the running wind to be smoothly flowed in a rearward direction without any resistance and to reduce wind whistling sound.

Whatever helmet type may be applied except the engaging means 26L in the second preferred embodiment in each of the aforesaid engaging means, it may be performed and they can be replaced from each other.

A fifth preferred embodiment of the present invention will be described, this preferred embodiment showing a form in which the cover member 55 is arranged at the full-face type helmet having the inner liner assembly 54 including the neck pad 57. Description and illustration of the overlapped portions of each of the aforesaid preferred embodiments will be omitted.

The full-face type helmet E of this preferred embodiment is formed such that the cover member 55 of U-shape as seen in its top plan view to cover an entire region of the lowermost surface of the inner liner assembly 54 except the chin inner liner member 53 and the discharging port 553 from below the neck pad 57 is arranged by the fixing method which is similar to that of each of the aforesaid preferred embodiments.

The cover member 55 is made of raw material similar to that of each of the aforesaid preferred embodiments, wherein in this preferred embodiment, the engaging means 56L, 56R are constituted to the similar means to that of the first preferred embodiment.

The full-face type helmet E in this preferred embodiment is constructed as described above, wherein the lowermost surface of the helmet ranging from the lower parts of the front surfaces of the cheek inner liner members 56L, 56R becomes a flat surfaces and the running wind can be flowed smoothly in a rearward direction without any resistance and it becomes possible to reduce wind whistling sound.

Whatever system pad type or fixed type of the full-face type helmet E in this preferred embodiment may be carried out and the aforesaid means of various kinds of configurations can be carried out also for the engaging means 56L, 56R.

Since the full-face type helmet of the present invention is constructed such that the pass-through surface for the running wind flowing at least at both right and left sides of the neck part of the helmet wearing person is made as a flat surface to cause the running wind to be flowed smoothly in a rearward direction without any resistance and to reduce the wind whistling sound, noise caused by the wind whistling sound during running is restricted and then a more comfortable and safe running can be assured by this reduction of noise against the helmet wearing person.

In addition, since the cover member is arranged at the lowermost surface of the inner liner assembly, the present invention has a similar effect of the prior art neck pad and a clearance between the cover member and the inner liner assembly is also eliminated, resulting in that flowing-in of the running wind can be prevented and an anti-cold effect may also be improved. Additionally, since the present invention has a quite simple configuration, its manufacturing cost is also similar cost to that of the prior art helmet and the aforesaid superior effect can be realized.

Further, the lowermost surface of the helmet is made as a flat surfaces, its lowermost surface may generate an integral assembled state and at the same time this is quite effective in view of its neat design as well as its outer appearance.

Accordingly, the present invention can provide a full-face type helmet in which the aforesaid object is accomplished, it can be constituted under a similar cost of the prior art and its design is quite superior.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope of the invention as defined by the appended claims.

What is claimed is:

1. A full-face type helmet comprising a shell, inner liner assemblies positioned within the shell, said inner liner assemblies including cheek inner liner members and a chin inner liner member, and a covering member positioned at at least both right and left sides of the shell, said covering member being fixed by supporting from near a lower end of the shell to a lower surface of the inner liner assemblies, the cover member being spaced apart at a forward extremity end part from the lower end of the shell with soft raw material, and formed to be elongated over the lower surfaces of the inner liner members at cheeks of the inner liner assemblies up to front end surfaces of the cheek inner liner members, its forward extremity end being engaged with one of the cheek inner liner members, the chin inner liner member, and the shell through engaging means, and lower surface of the cover member being formed as a flat surface having no step.

* * * * *